US006752702B1

(12) United States Patent
Thompson et al.

(10) Patent No.: US 6,752,702 B1
(45) Date of Patent: Jun. 22, 2004

(54) KNIFE SHARPENER

(76) Inventors: Ted Thompson, 2475 Hwy., 115 Imboden, AR (US) 72434; Mike Neshat, 1604 Whitehaven Ct., Jonesboro, AR (US) 72401; Bryan Butts, 903 S.E. 6th, Walnut Ridge, AR (US) 72476

( * ) Notice: Subject to any disclaimer, the term of this patent is extended or adjusted under 35 U.S.C. 154(b) by 0 days.

(21) Appl. No.: 10/177,340

(22) Filed: Jun. 24, 2002

(51) Int. Cl.[7] ..... B24B 7/00
(52) U.S. Cl. ..... 451/177; 451/344; 451/359
(58) Field of Search ..... 451/177, 192, 451/193, 194, 205, 344, 359, 391

(56) References Cited

U.S. PATENT DOCUMENTS

| | | | | | |
|---|---|---|---|---|---|
| 5,645,470 | A | * | 7/1997 | Ludwig | 451/45 |
| 6,039,642 | A | * | 3/2000 | Collins | 451/557 |
| 6,071,183 | A | * | 6/2000 | Havins | 451/296 |
| 2002/0098783 | A1 | * | 7/2002 | White | 451/45 |

* cited by examiner

*Primary Examiner*—Lee D. Wilson
(74) *Attorney, Agent, or Firm*—Dennis B. Haase

(57) ABSTRACT

A multiple station knife sharpener in which a single pass of the blade of a knife accomplishes a coarse grind, fine grind and buff of the edge of the blade, and further having a station for the sharpening of a fish hook or the like.

20 Claims, 3 Drawing Sheets

KNIFE SHARPENER

The present invention relates generally to devices for sharpening knife blades and, more particularly, to electric knife sharpeners which will not only sharpen, but buff such blades in a single pass, and having an additional station for the sharpening of a fish hook or the like.

BACKGROUND OF THE INVENTION

1. Field of the Invention

While the venerable whetstone remains a staple in the repertoire of the outdoorsman as a means of putting an edge on his or her knife, there is an ever increasing demand for devices which accomplish tasks faster, easier and better. To this end, there have been efforts to mechanize the sharpening process, resulting in an array of mechanical and electrical devices introduced to the marketplace.

2. Overview of the Prior Art

Perhaps the most rudimentary device for sharpening the cutting edge of a blade is the whetstone, and one of the more novel mechanical devices created in aid of the sharpening process is the device disclosed in Pregrove patent number U.S. Pat. No. 6,168,509 B1 for positioning a blade between a pair of angularly disposed stones 30.

Perhaps a more commercially acceptable device may be found in the teachings of Friel U.S. Pat. No. 5,390,431, although the motive power is, once again, human, with the blade being drawn through a slot in a housing and into contact with one or more abrasive surfaces.

More to the point, as relates to the novel sharpener of the present invention, are those sharpeners in which the abrasive surface is circular and driven by an electric motor, whether AC or DC. Exemplary of this class of consumer friendly electric sharpeners are Friel, Sr. et al. U.S. Pat. Nos. 6,012,971 and 6,113,476. In these patents the abrasive surface is aligned with a slot in a housing so that the user may draw the blade through the slot against the rotating wheel to sharpen one side, or the other, or in some cases, both sides of a blade.

SUMMARY OF THE INVENTION

The present invention comprises a multi station powered blade sharpener in which a knife blade may be sequentially coarse ground, fine ground, and buffed in a single pass, in a device which is compact, very simply manipulated and easy to handle, and having an additional feature, dear to the heart of any fisherman, of being able to sharpen a fishing hook.

It is, accordingly, a principal objective of the present invention to provide the outdoorsman, and particularly a fisherman, with a compact device which can be carried in a back pack or tackle box and which will coarse grind, fine grind and buff a knife blade in a single pass and, additionally, sharpen a fish hook as needed. It is a corollary to the foregoing to provide such a device which may be powered by a 110V AC, or by a 12V DC motor, as the users' circumstances dictate and, in either configuration, prevent overheating of the motor.

Yet another objective of the present invention is to provide a sharpener that will dress the back of a hook as well as sharpen the points thereof.

The foregoing, as well as additional objects and advantages of the sharpener of the present invention will become apparent to those skilled in the art as they read the Detailed Description of a Preferred Embodiment, in conjunction with the drawings, wherein:

DETAILED DESCRIPTION OF A PREFERRED EMBODIMENT

Figure 1:
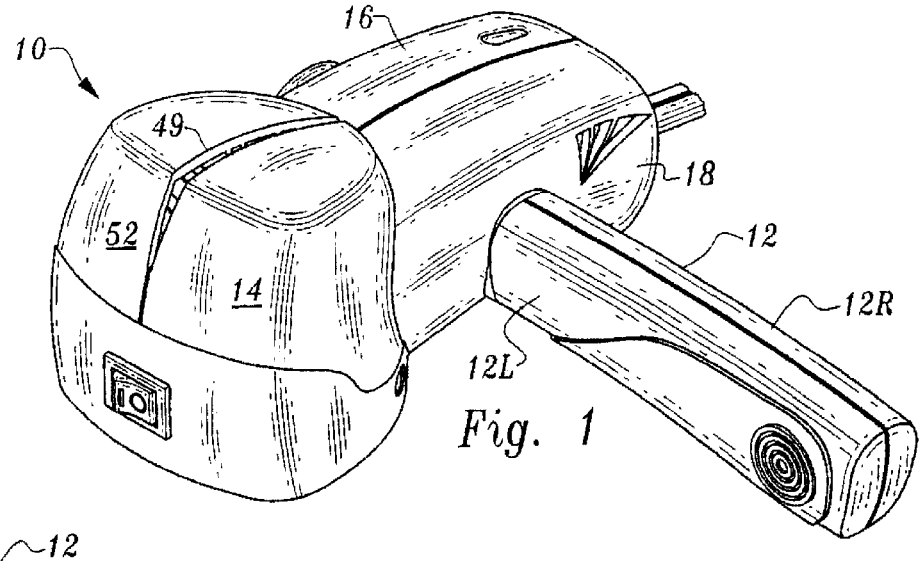
FIG. 1 is a pictorial view of the blade sharpener of the present invention, shown in perspective with the grip projecting from the left side thereof.
Figure 2:
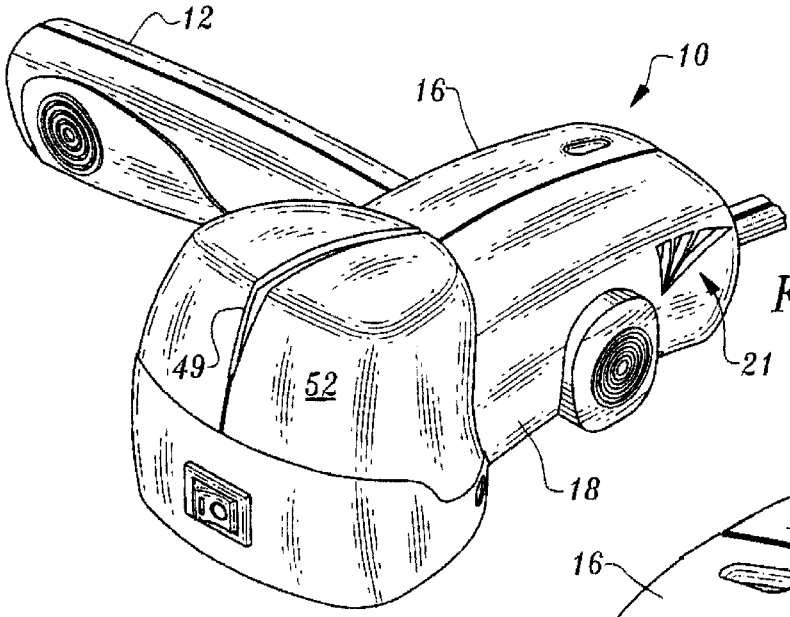
FIG. 2 is a view similar to FIG. 1, with the exception that the handle is projecting from the right side thereof.

With reference now to the drawings, and initially to FIG. 1, there is a pictorial representation of a blade sharpener device 10, constructed in accordance with the present invention. A handle 12 projecting outwardly from the sharpener device, and transverse to the longitudinal axis thereof, is provided in keeping with one aspect of the invention, and FIGS. 1 and 2 illustrate the versatility of the handle as being capable of being removably positioned on either side of the housing 14 of the sharpener, and thereby useable by either a left handed or right handed person. As is evident in FIGS. 1–3, the handle is conveniently formed in two mating halves 12L and 12R, although it is within the contemplation of the invention that the handle be a single piece, or several, depending on the particular manufacturing procedure followed.

The sharpener 10 is designed to be both compact and readily portable. The housing 14 is formed in two substantially identical longitudinally extending halves 16 and 18, with the exception that the halves are mirror images of one another. The halves are joined by suitable fasteners, not shown, in order that they may be separated as may be needed for repair or replacement.

On either side of the sharpener, formed in each of the halves 16 and 18, vents 21 are formed in order to permit air to circulate in the interior cavity of the sharpener to cool the operative elements disposed therein. Below, and somewhat forward of the vents, each of the halves is formed with a handle receiving socket 23.

The handle 12 is formed with a connector 25 at an end 27 thereof, which is a raised portion, i.e., a portion 29 extended outwardly from the end 27, to define a bow tie shape. Again, however, it will be apparent that the precise shape is, to a limited extent, a matter of choice so long as it functions to accomplish selective attachment of the handle 12.

Figure 3:
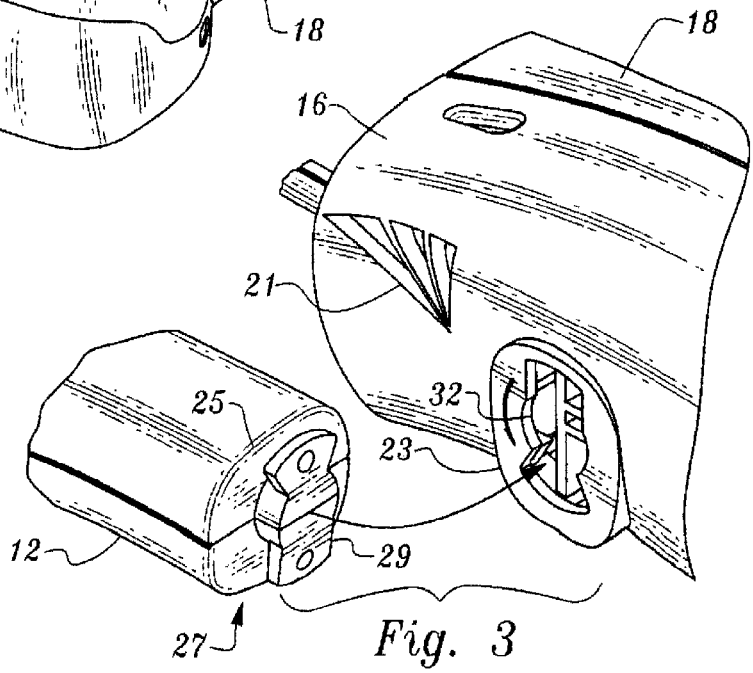
FIG. 3 is a fragmented view of that area of the sharpener where the grip attaches to the housing, illustrating in some detail, the manner in which the grip is attached.
Figure 4:
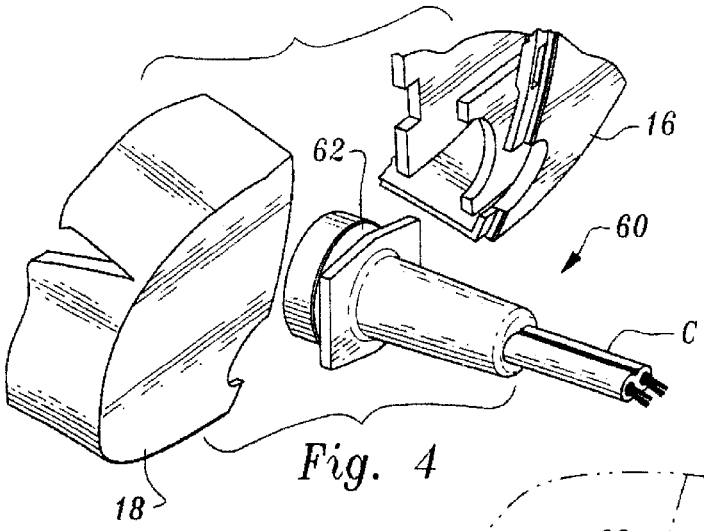
FIG. 4 is a fragmented view of the housing at the point where the power cord enters the housing, exploded to illustrate certain details of the grommet which insulates and protects the cord from excessive strain resulting from mishandling of the tool.

As best seen in FIG. 3, the raised portion is adopted to be received in a recess 32 formed in the socket 23 in the housing. Once in the socket 23, rotation of the handle as little as 900 will effect a lock between the side of the housing chosen by the user and the handle, which is, thus, secured for use in manipulating the sharpener as the sharpening process proceeds.

Figure 6:
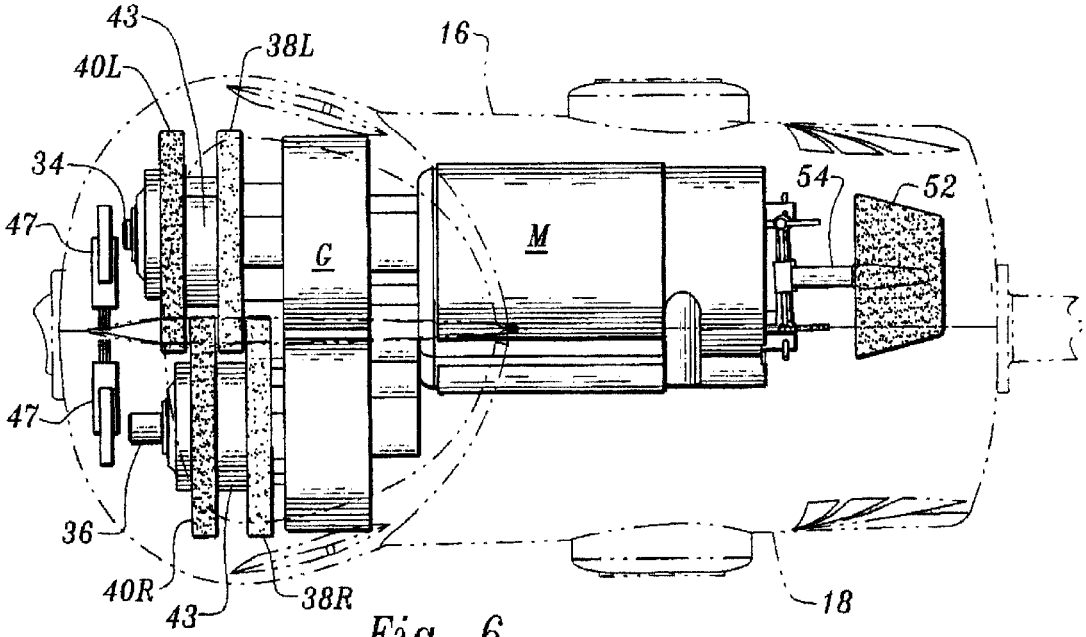
FIG. 6 is a top plan view of the sharpener of the present invention with the housing shown in shadow in order to expose and detail the relative position of the internal workings of the sharpener.
Figure 7:
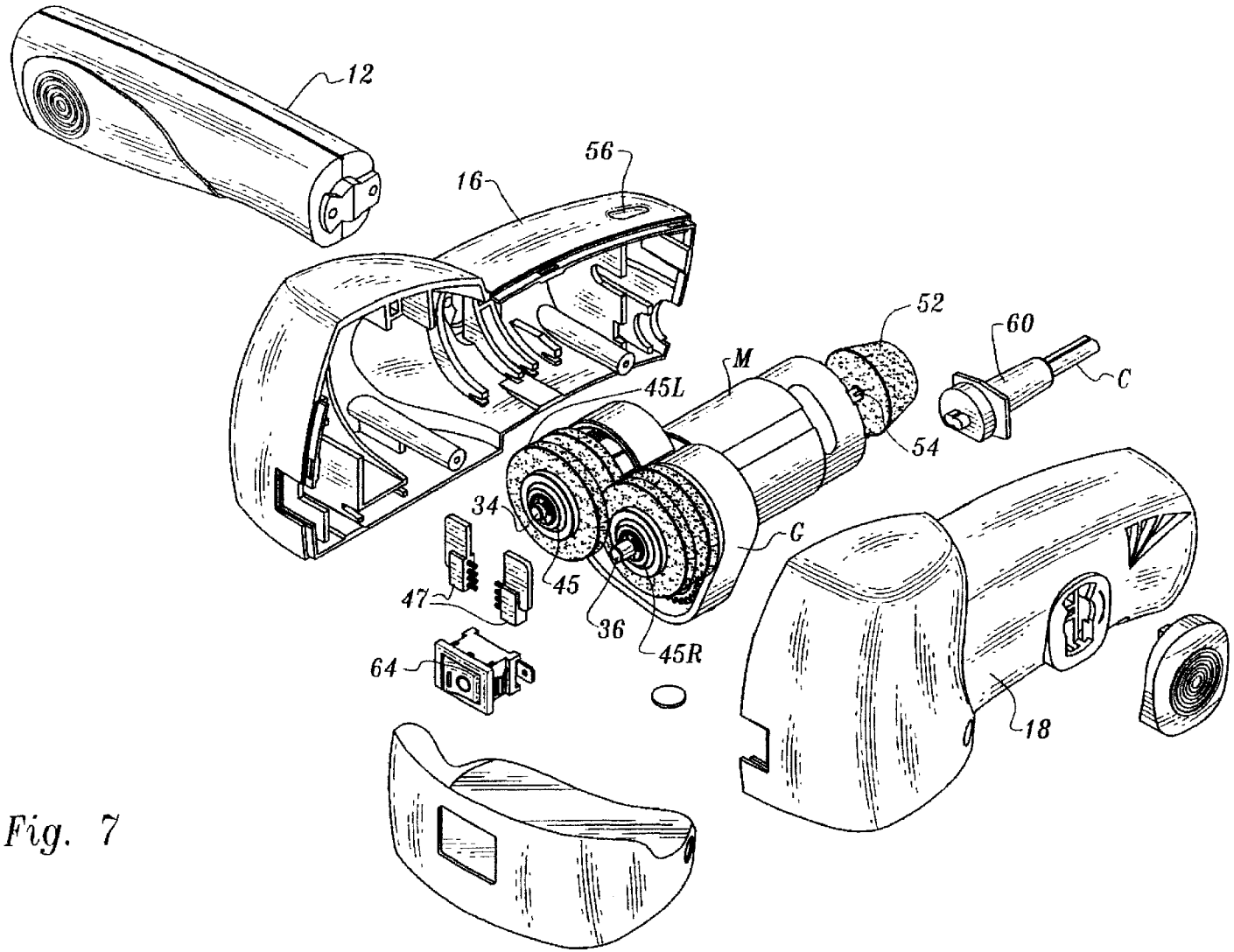
FIG. 7 is an exploded view of the sharpener of FIG. 2, providing further insight into the relative location and position of the various elements of the sharpener.

The housing 14 houses the operative elements of the sharpener, which nest securely therein. With reference to FIGS. 6 and 7, an electric motor M is illustrated as connected directly to a split drive gear box G, interposed between the motor and the grind assemblies. Extending outwardly from the gear box G are a pair of co-planer counter rotating drive shafts 34 and 36 upon which are found, in driving relation, a coarse grind assembly 38 comprising a pair of coarse grind wheels, best seen in FIG. 6. As best seen from the perspective of FIG. 7, and for purposes of safety, the left hand shaft 34 rotates clockwise and shaft 36, counterclockwise.

The wheels are alternately designated as 38L and 38R, indicating their relative position when viewed from the front of the sharpener, are transversely spaced from each other, wheel 38L being slightly forward of 38R as seen in FIG. 6, on the shafts 34 and 36, such that a centrally disposed grove is defined between them above the plane of the shafts, even though the wheels of each assembly themselves overlap one another in the plane of the shafts, which plane is essentially horizontal when the sharpener is in its ordinary and usual attitude. The grove so formed is of such dimension as to accommodate the blade of a knife to be sharpened.

In keeping with the objectives of the invention, forward of the coarse grind wheel assembly 38, mounted on the shafts 34 and 36 for rotation therewith is a fine grind assembly 40 comprising a pair of fine grind wheels, which may also bear the designation 40L and 40R, again to indicate their relative positions when the sharpener is viewed from the front. As in the case of the coarse grind wheel 38, the fine grind wheel 40L is slightly forward of the wheel 40R, and together they define a groove above the plane of the drive shafts, which grove is contiguous, and axially aligned, with the groove defined by and between the wheels 38. Spacers 43 are conveniently provided to locate and define the space between the coarse and fine wheels on each shaft.

Suitable fasteners, e.g., snap rings, 45 secure the wheels to the shafts 34 and 36.

Further in keeping with the invention, and in order to knock of any dust or other foreign matter which might be raised on the knife during sharpening, a buff is provided in the guise of a pair of opposed brushes 47 forward of the wheels 38 and 40. The brushes have vertically disposed rows of randomly placed appropriately stiff bristles in order to be effective acting against a perhaps hardened, steel knife blade. Additionally, and further in keeping with the invention, the bristles overlap slightly in the plane defined by the groove between the wheels 38L and 38R and 40L and 40R in order to insure that there is adequate contact with both sides of the blade being sharpened.

As perhaps best illustrated in FIGS. 1 and 2, the housing 14 is formed with an elongated opening or slot 49 which is disposed in the plane of the groves defined by the wheels 38 and 40, and along the longitudinal axis of the sharpener, which is also the seam between the halves of the housing. The slot further extends downwardly along the face 52 of the housing to the plane of the shafts 34 and 36, thereby providing a passageway, defining a guide in the head of the sharpener housing , through which the user can draw the blade of a knife to be sharpened from right to left (as seen in FIGS. 1, 2, 6, and 7) and with such a single stroke may sequentially coarse grind, fine grind and buff the sharpened edge thereof. It will be evident that should an additional pass be beneficial, the user need only repeat the step just described.

It is yet another salutary feature of the present invention, peripheral to the features just described, yet incredibly useful to the sportsman using the sharpener of the present invention, is the ability to additionally sharpen a fishing hook or the like. To this end a grinding wheel 52 is disposed on a shaft 54 (FIGS. 6 and 7) which protrudes from the rear of the motor M. An opening or window 56 near the rear of the housing (FIGS. 1 and 2) provides ready access to the surface of the grinding wheel, which wheel is in the shape of a truncated cone and ideal for the sharpening of a hook.

Figure 5:
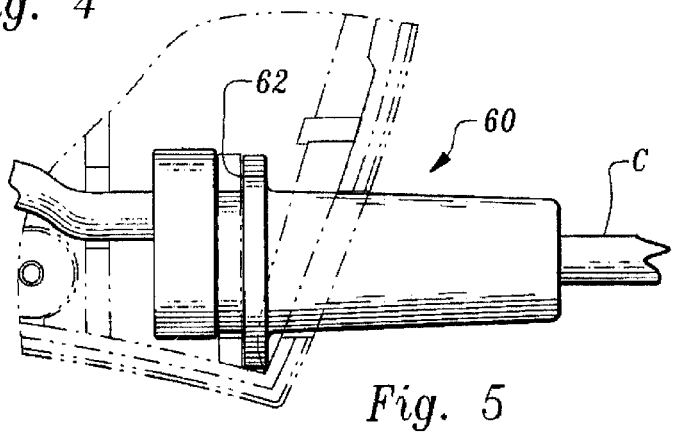
FIG. 5 is a partial sectional view of the sharpener housing, which is shown in shadow detail, illustrating the relative position of the cord and grommet relative to the housing when fully assembled.

The sharpener 10 of the present invention is intended to provide particular utility for the outdoorsman who needs to sharpen his knife or fish hook in the field, and since it is electrically motivated, whether by a 110V supply, or a 12V supply, it is important, and an objective of the present invention, to make the device as injury proof as reasonably practical. To this end, and to prevent internal wiring damage resulting from inadvertent or mishandling of the sharpener by yanking on the cord, a grommet 60 is provided, in keeping with this aspect of the invention. The grommet tightly circumscribes the electrical cord C (FIG. 5), to provide strain relief and, to this end, is formed with a groove 62 which snaps into place tightly gripping the sidewall of the housing, thereby inhibiting the inadvertent damage to the electrical connection by mishandling of the sharpener by the electrical cord. A switch 64, which in its illustrated configuration, is a simple rocker switch, may clearly assume other switch forms without departure from the essence of the invention.

Having thus described a preferred embodiment of the present blade sharpener, what is claimed is:

What is claimed is:

1. A device for sharpening the blade of a knife, comprising, in combination:

a coarse grind wheel assembly;

a fine grind wheel assembly; said fine grind wheel assembly being axially aligned with said coarse grind wheel assembly, said coarse grind wheel assembly and said fine grind wheel assembly being encased in a housing;

a guide in said housing for accessing the blade of the knife over said coarse grind assembly and said fine grind assembly in sequence and with a single stroke to thereby first apply coarse grind then fine grind to the blade to thereby create a sharp edge thereon.

2. The sharpener of claim 1, wherein said coarse grind assembly comprises a pair of transversely spaced overlapping coarse grind wheels and said fine grind assembly comprising a pair of transversely spaced overlapping fine grind wheels.

3. The sharpener of claim 1 including a buff, said buff being axially aligned with said coarse grind assembly and said fine grind assembly such that the blade of the knife is drawn across said buff after it passes through said fine grind assembly.

4. The sharpener of claim 3, wherein said buff comprises a series of bristles defining a brush; one of said brushes being disposed on either side of said path defined by said coarse grind and fine grind assemblies, and said brushes positioned to contact the blade of a knife or the like moving along said path.

5. The sharpener of claim 1, wherein a motor is provided in said casing, said motor adapted to drive said wheels.

6. The sharpener of claim 5 having a gear box in said casing, said gear box disposed between said motor and said wheels to drive the respective wheels of each of the coarse and fine assemblies in opposite directions, and toward the blade of a knife disposed therein.

7. The sharpener of claim 1 wherein a grind wheel is provided to the rear of said housing, said coarse grind and fine grind assemblies, said grind wheel adopted to sharpen a fish hook.

8. A device for sharpening the blade of a knife, comprising, in combination:

a coarse grind wheel assembly;

a fine grind wheel assembly;

a motor for driving said coarse grind and fine grind assemblies;

a housing, said motor and said coarse and fine grind assemblies being housed in said housing;

said assemblies being axially aligned in said housing, a slot in said housing, said slot defining a guide across said coarse and fine grind assemblies, said slot being aligned with said assemblies such that as the blade of a knife, moved in said slot, and drawn across said assemblies, the blade is first subjected to coarse grind and thereafter fine grind to the edge of the blade.

9. The sharpener of claim 8 having a handle, said handle being removably fixed to said housing in a position which is transverse to the longitudinal axis thereof.

10. The sharpener of claim 9, wherein said handle is removably fixable to either side of said housing at the election of the user.

11. The sharpener of claim 8, wherein said coarse grind assembly comprises a pair of transversely spaced overlapping coarse grind wheels and said find grind assembly comprising a pair of transversely spaced overlapping fine grind wheels.

12. The sharpener of claim 8, including a buff, said buff being axially aligned with said coarse grind assembly and said fine grind assembly such that the blade of the knife is drawn across said buff after it passes through said fine grind assembly.

13. The sharpener of claim 8, wherein said buff comprises a series of bristles defining a brush; one of said brushes being disposed on either side of said path defined by said coarse grind and fine grind assemblies, and said brushes positioned to contact the blade of a knife moving along said path.

14. The sharpener of claim 8, wherein a motor is provided, said motor adapted to drive said wheels.

15. The sharpener of claim 8 having a gear box, said gear box disposed between said motor and said wheels to drive the respective wheels of each of the coarse and fine assemblies in opposite directions, and toward the blade of a knife disposed therein.

16. The sharpener of claim 15, wherein an opening is formed in said housing, said opening being located immediately above and providing access to said grind wheel in order that the user may place a fish hook in contact with said grind wheel.

17. The sharpener of claim 16, having an on/off switch, said on/off switch interposed between said power source and said motor in said power cord.

18. The sharpener of claim 8, wherein a grind wheel is provided to the rear of said coarse grind and fine grind assemblies, said grind wheel adopted to sharpen a fish hook.

19. The sharpener of claim 16, having a power cord, said power cord connecting said motor to a power source;

a grommet; said grommet attached to and encircling said power cord, said grommet engaging said housing to inhibit damage to the connection between said power cord and said motor by inadvertent stress on said cord.

20. The sharpener of claim 8, having a power cord, said power cord connecting said motor to a power source;

a grommet; said grommet attached to and encircling said power cord, said grommet engaging said housing to inhibit damage to the connection between said power cord and said motor by inadvertent stress on said cord.

* * * * *